US007735240B2

(12) United States Patent
Lee

(10) Patent No.: US 7,735,240 B2
(45) Date of Patent: Jun. 15, 2010

(54) SHOE SOLE FOR CORRECTING GAIT

(75) Inventor: Eun Jae Lee, Busan (KR)

(73) Assignee: Z-Coil Ltd. (KR)

( * ) Notice: Subject to any disclaimer, the term of this patent is extended or adjusted under 35 U.S.C. 154(b) by 808 days.

(21) Appl. No.: 11/627,958

(22) Filed: Jan. 27, 2007

(65) Prior Publication Data

US 2007/0180733 A1 Aug. 9, 2007

(30) Foreign Application Priority Data

Feb. 3, 2006 (WO) ..... PCT/KR2006/000371

(51) Int. Cl.
*A43B 13/28* (2006.01)

(52) U.S. Cl. ..... 36/27; 36/15; 36/38

(58) Field of Classification Search ..... 36/27, 36/15, 28, 36 R, 36 A, 36 B, 38, 36 C, 39, 36/42

See application file for complete search history.

(56) References Cited

U.S. PATENT DOCUMENTS 1,127,456 A 2/1915 Kurtz
1,977,777 A * 10/1934 Rhodes ..... 36/36 R
2,208,260 A * 7/1940 Hayden ..... 36/39
2,943,404 A * 7/1960 Sultan ..... 36/42
3,478,447 A * 11/1969 Gillead ..... 36/36 B
3,886,674 A 6/1975 Pavia
3,996,677 A 12/1976 Reina
4,296,557 A 10/1981 Pajevic
4,492,046 A 1/1985 Kosova
4,566,206 A 1/1986 Weber
4,592,153 A 6/1986 Jacinto
5,435,079 A 7/1995 Gallegos
5,511,324 A * 4/1996 Smith ..... 36/27

(Continued)

FOREIGN PATENT DOCUMENTS

JP 61-179905 11/1986

(Continued)

*Primary Examiner*—Marie Patterson
(74) *Attorney, Agent, or Firm*—Brooks Kushman P.C.

(57) ABSTRACT

Disclosed herein is a shoe sole having functions of correcting a gait, of absorbing shocks, and of mitigating partial side wear of the sole. The shoe sole according to the present invention includes a main sole, which has a front foot part provided with a soft front midsole and a front outsole, and has a rear foot part provided with a hard rear midsole. The shoe sole further includes a subsidiary sole. The subsidiary sole includes an elastic member, a rear outsole, which is coupled to the lower end of the elastic member, and a connection member, which is provided on the upper end of the elastic member. The connection member has an internal threaded part, which couples the connection member to the rear midsole, and stop protrusions, which are provided around the internal threaded part. The shoe sole further includes a coupling support, which is provided under the rear midsole. Stop holes corresponding to respective stop protrusions are formed in the coupling support. A through hole is formed in the coupling support at the center of the stop holes, so that a bolt can be secured into the internal threaded part through the through hole. Therefore, the orientation of the subsidiary sole with respect to the main sole is changeable, or the subsidiary sole is replaceable with a new one, depending on the characteristics of the gait of a user.

18 Claims, 10 Drawing Sheets

U.S. PATENT DOCUMENTS

| | | | | |
|---|---|---|---|---|
| 6,631,570 | B1 * | 10/2003 | Walker | 36/100 |
| 7,055,264 | B2 * | 6/2006 | Gallegos | 36/3 B |
| 2006/0112592 | A1 * | 6/2006 | Leedy et al. | 36/29 |
| 2006/0213082 | A1 | 9/2006 | Meschan | |

FOREIGN PATENT DOCUMENTS

| | | |
|---|---|---|
| JP | 9-224704 | 9/1997 |
| KR | 184556 | 3/2000 |

* cited by examiner

SHOE SOLE FOR CORRECTING GAIT

CROSS-REFERENCE TO RELATED APPLICATIONS

This application claims foreign priority benefits under 35 U.S.C. §119(a)-(d) to PCT/KR2006/000371, filed Feb. 3, 2006, which is hereby incorporated by reference in its entirety.

BACKGROUND OF THE INVENTION

1. Field of the Invention

The present invention relates generally to shoe soles, and, more particularly, to a shoe sole which has functions of correcting a gait, of absorbing shocks, and of mitigating partial side wear of the sole.

2. Background Art

Shoes, which are a life necessity, have rapidly developed in function as well as in design. The design of the shoes is very important in arousing consumers' interest, and thus new products have been continuously proposed. Furthermore, recently, various functional shoes have been popularized. Special purpose shoes, which are used in exercise, or shoes having functions of curing or mitigating disorders of users are representative examples of such functional shoes.

Meanwhile, human beings who walk upright may congenitally or developmentally have an abnormal gait. Particularly, in the case of a user having a developmentally abnormal gait, if the abnormal gait is not corrected in an initial stage thereof, it may get worse.

According to the position of the foot with respect to the ground when the foot contacts the ground, the gait of humans is classified into a neutral gait, in which the foot perpendicularly contacts the ground, a pronation gait, in which the foot is inclined inwards, and a supination gait, in which the foot is inclined outwards.

In the case of a user having a pronation gait or a supination gait, if the user wears shoes that are manufactured for users having neutral gaits, the abnormal gait cannot be corrected, and may get worse instead. To correct the abnormal gait, the user must buy separate shoe insoles or shoe inserts suitable for his/her feet, or must use separate shoe insoles or shoe inserts which are manufactured at a relatively high cost in a special foot clinic. As such, due to the cost and time constraints, there is a problem in that it is difficult for a user having an abnormal gait to correct the gait.

Meanwhile, in the case where even a user having a neutral gait uses shoes for a long period, left and right portions of the heel of each shoe may wear unevenly. Such a partial side wear phenomenon of the heel of the shoe reduces the lifetime of the shoe, and may affect the gait of the user. In the case of a user having an abnormal gait, this problem is more clearly evident.

It is impossible to completely overcome the partial side wear phenomenon of the heel of the shoe sole. Therefore, in the conventional arts, various methods of merely compensating for or mitigating the partial side wear phenomenon have been proposed. Representative conventional techniques pertaining to this will be explained herein below.

Representatively, there are Korean Utility Model Registration No. 184556, Japan Patent Laid-open Publication No. Heisei. 9-224704, Japan Utility Model Laid-open Publication No. Sho. 61-179905, and U.S. patent Publication No. 2006-213082.

In U.S. patent Publication No. 2006-213082, a coil spring is provided in the heel of a shoe sole, and is covered with a platform, which is fastened into the heel in a thread coupling method. Thus, the height of the heel and the elastic force of the coil spring are adjustable. However, this technique has no gait correction function.

In the remaining conventional techniques, part of the heel is provided so as to be rotatable, so that, when partial side wear occurs, the part of the heel is rotated, thus preventing only a small portion of the heel from being excessively worn. These techniques merely mitigate the partial side wear phenomenon of the heels, but there is a technical limit in their ability to correct abnormal gaits.

Meanwhile, another related technique was proposed in U.S. Pat. No. 5,435,079, entitled "SPRING ATHLETIC SHOE". FIG. 1 is a side view showing the spring athletic shoe of U.S. Pat. No. 5,435,079.

In this technique, part of a shoe sole is removed to form space therein, and a spring is provided in the space at a position corresponding to the heel of the shoe. The purpose of this technique is to provide sufficient shock absorbing ability. However, because the spring is fixed, it cannot be used for a purpose of correcting the gait.

SUMMARY OF THE INVENTION

Accordingly, the present invention has been made keeping in mind the above problems occurring in the prior art, and an object of the present invention is to provide a shoe sole which includes an elastic member, such as a spring, which is a critical part, and has a function of correcting an abnormal gait as well as having basic functions of absorbing shocks and mitigating partial side wear of the sole.

Another object of the present invention is to provide a shoe sole in which a subsidiary sole is removably coupled to a main sole, so that the subsidiary sole can be easily replaced with a new one, and the orientation of the subsidiary sole relative to the main sole can be easily adjusted.

In order to accomplish the above object, the present invention provides a shoe sole for correcting a gait, comprising: a main sole, including a front foot part, having a front midsole made of soft material and a front outsole provided under a lower surface of the front midsole, and a rear foot part, having a rear midsole made of hard material and coupled to an upper surface of the front midsole; a subsidiary sole, including an elastic member, a rear outsole coupled to a lower end of the elastic member and in contact with ground, and a connection member provided on an upper end of the elastic member, the connection member having an internal threaded part to couple the connection member to a lower surface of the rear midsole and a plurality of stop protrusions provided around the internal threaded part; and a coupling support provided under the lower surface of the rear midsole, with a plurality of stop holes formed in the coupling support and corresponding to the respective stop protrusions, and a through hole formed in the coupling support at a center of the stop holes and extending to an upper surface of the rear midsole so that a bolt is fastened into the internal threaded part through the through hole, wherein an orientation of the subsidiary sole with respect to the main sole is changeable, or the subsidiary sole is replaceable with another subsidiary sole depending on characteristics of the gait of a user.

Preferably, the elastic member may comprise a conical coil spring.

The elastic member may be formed by injection molding using different materials such that the elastic member is sectioned into four sections having different characteristics.

The connection member may be integrally coupled to an upper end of the conical coil spring through an injection molding process.

The connection member may include four arms provided on an outer edge of a lower end of the connection member at positions spaced apart from each other by angular intervals of 90°, such that, when the elastic member is formed by injection molding using the different materials, a coupling force between the connection member and the elastic member is increased by the four arms.

The subsidiary sole may include a protective wall provided on the rear outsole to surround the elastic member.

The connection member may include a main nut forming the internal threaded part; and a wire nut provided in the main nut and coupled to the bolt to prevent the bolt from being loosened.

The conical coil spring may be made of a wire, which has a cross-section having one shape selected from among a rectangular shape, an octagonal shape, a circular shape and a tube shape.

The wire constituting the conical coil spring may be made of metal or a compound substance containing carbon fiber and glass fiber.

The rear midsole may be made of material, in which 10 to 15 weight parts of glass fiber are mixed with 100 weight parts of nylon 66 resin, and be injection molded at a high temperature.

The shoe sole may further comprise a reinforcing member provided in the rear outsole and manufactured by weaving into a mesh shape.

The shoe sole for correcting the gait according to the present invention can be used in various kinds of shoes, including sports shoes. Those skilled in the art will appreciate that various modifications, additions and substitutions are possible, without departing from the scope and spirit of the present invention. Furthermore, such modifications, additions and substitutions fall within the bounds of the present invention.

BRIEF DESCRIPTION OF THE DRAWINGS

The above and other objects, features and advantages of the present invention will be more clearly understood from the following detailed description taken in conjunction with the accompanying drawings, in which.

DETAILED DESCRIPTION OF THE PREFERRED EMBODIMENT(S)

Hereinafter, a shoe sole for correcting a gait (hereinafter, referred to simply as "shoe sole") according to the present invention will be described in detail. The attached drawings merely show preferred embodiments, which fall within the bounds of the technical spirit of the present invention.

First Embodiment

Figure 1:
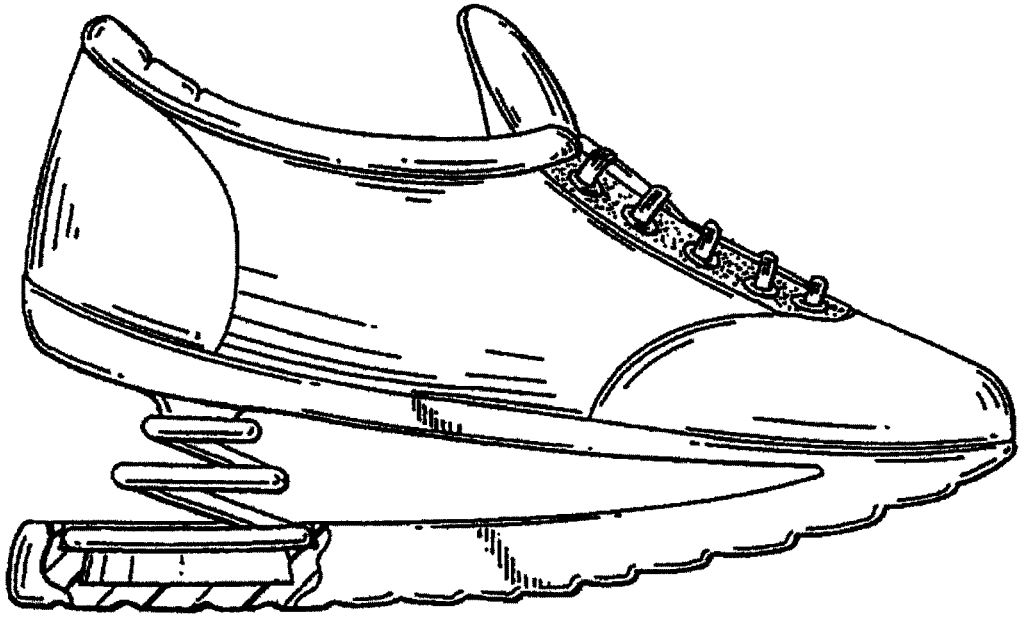
FIG. 1 is a side view showing a spring athletic shoe according to a conventional technique.
Figure 2:
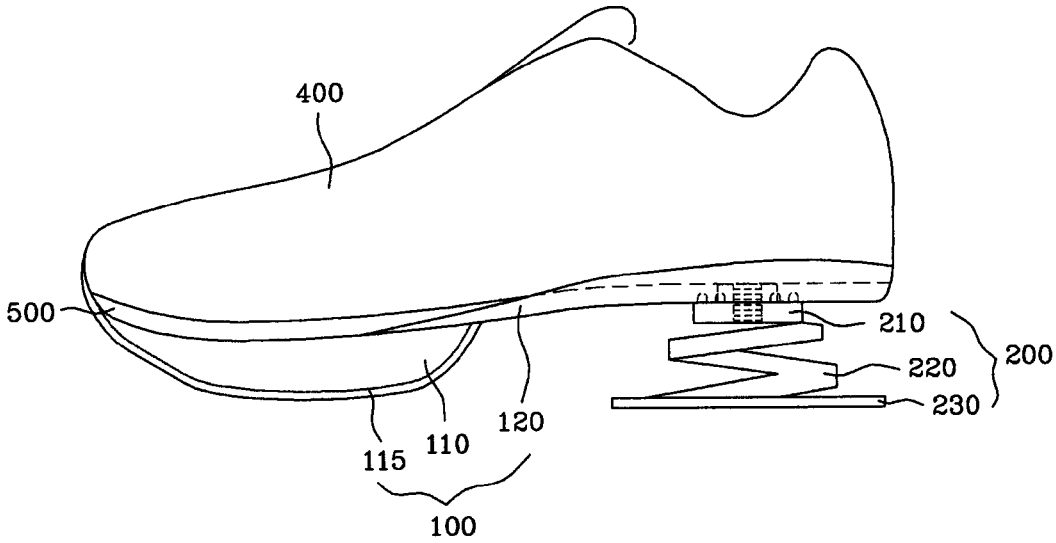
FIG. 2 is a schematic view of a shoe having a shoe sole for correcting a gait, according to a first embodiment of the present invention.
Figure 3:
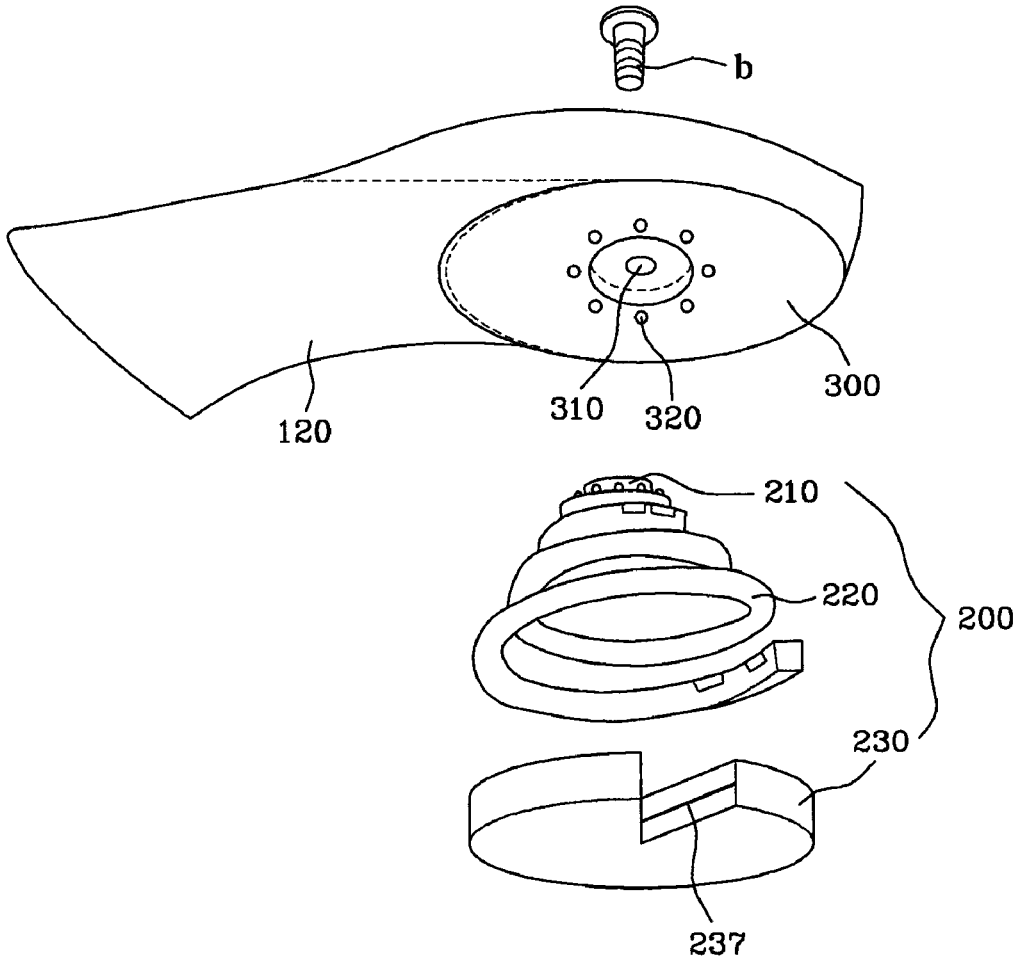
FIG. 3 is an exploded perspective view showing an important part of the shoe sole of FIG. 2.
Figure 4:
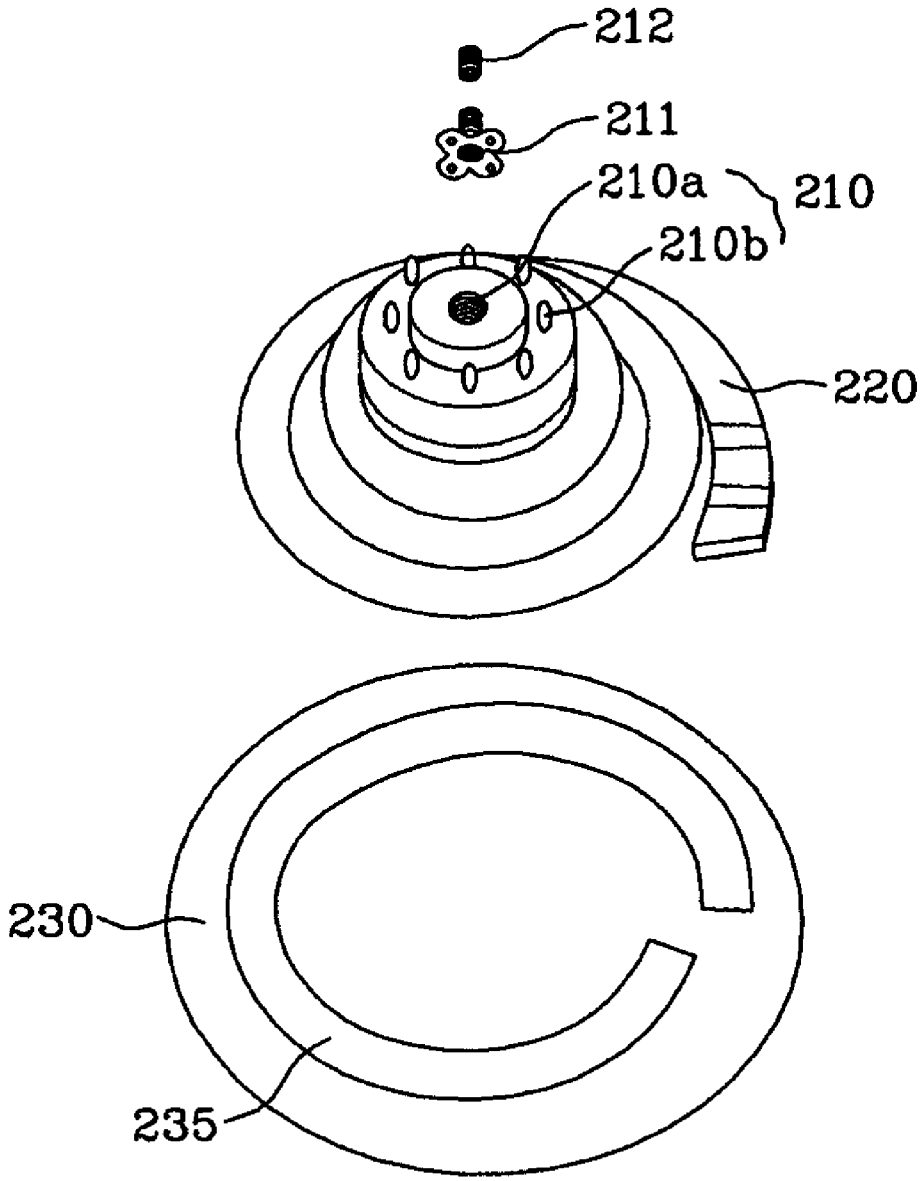
FIG. 4 is an exploded perspective view of a subsidiary sole of the shoe sole of FIG. 2.

FIG. 2 is a schematic view of a shoe having a shoe sole, according to a first embodiment of the present invention. FIG. 3 is an exploded perspective view showing an important part of the shoe sole. FIG. 4 is an exploded perspective view of a subsidiary sole 200 of the shoe sole.

As shown in the drawings, the shoe sole of the present invention includes a main sole 100, the subsidiary sole 200 and a coupling support 300. A shoe upper 400 is coupled on the main sole 100, thus forming the shoe. In other words, to form the shoe, the shoe upper 400 is coupled to the main sole 100, and an insole 500 is provided in the shoe upper 400. Of course, to ensure the ability to replace the subsidiary sole 200 coupled to the main sole 100, the shoe must be constructed such that a bolt b, which is fastened into the main sole 100 in the shoe upper 400, can be easily accessed, which allows it to be tightened or loosened.

The main sole 100 includes a front midsole 110 and a rear midsole 120. The rear midsole 120 is coupled to the upper surface of the front midsole 110. Furthermore, the front midsole 110 is made of material that is softer than that of the rear midsole 120. A front outsole 115 made of rubber is coupled to the lower surface of the front midsole 110. The front midsole 110 forms a front foot part, and the rear midsole 120 forms a rear foot part. The front midsole 110 serves to absorb shocks. The front outsole 115 is in direct contact with the ground to prevent slippage and prevent the front midsole 110 from being damaged.

The rear midsole 120 is made of material that is harder than that of the front midsole 110. In this embodiment, the rear midsole 120 is made of material in which 10 to 15 weight parts of glass fiber are mixed with 100 weight parts of nylon 66 resin. In detail, nylon 66 resin is mixed with glass fiber, and the mixture is processed by injection molding at approximately 250° C. and is cooled, thus forming the rear midsole 120. Preferably, a product, which has been formed by injection molding at a relatively high temperature, is placed in water at 100° C. for about 15 minutes, thus completing the product.

The front midsole 110 may be made of typical foam or E.V.A. The rear midsole 120 may be made of well-known synthetic resin, or alternatively of a mixture of nylon 66 resin and glass fiber.

Meanwhile, the subsidiary sole 200 is coupled to the lower surface of the rear midsole 120. To couple the subsidiary sole 200 to the rear midsole 120, the coupling support 300 is provided under the lower surface of the rear midsole 120. The coupling support 300 may protrude from the lower surface of the rear midsole 120, and the lower surface of the coupling support 300 is generally planar. A through hole 310 is formed through the center of the coupling support 300, and extends to the upper surface of the rear midsole 120. Furthermore, several stop holes 320 are formed in the coupling support 300 around the through hole 310. The bolt b is inserted into the through hole 310 and is fastened to a connection member 210 of the subsidiary sole 200, which will be explained later herein. In the embodiment, as shown in the drawings, eight stop holes 320 are arranged in a circular arrangement. The orientation of the subsidiary sole coupled to the rear midsole 120 can be changed using the stop holes 320.

Below, the subsidiary sole 200, which is coupled to the main sole 100 through the coupling support 300 using the bolt b, will be explained in detail. The subsidiary sole 200 includes an elastic member 220, a rear outsole 230, which is coupled to the lower end of the elastic member 220, and the connection member 210, which is provided on the upper end of the elastic member 220. In the first embodiment, a conical coil spring is used as the elastic member 220. The elastic member 220 has a shape which is reduced in diameter from the bottom to the top thereof.

Figure 5:
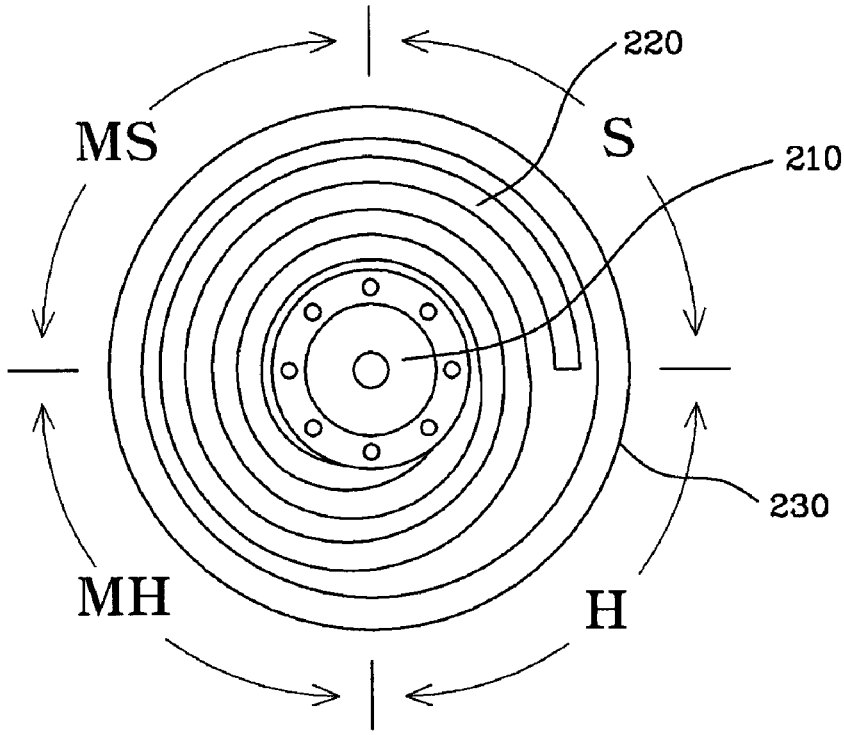
FIG. 5 is a plan view showing the distribution of hardness of a rear outsole, when a conical coil spring is used as an elastic member, according to the present invention.

Due to the features of the shape of the conical coil spring, different forces are applied to different portions of the edge of the rear outsole 230. That is, the elastic member 220 can exhibit the same effect as a structure in which several elastic bodies having different elastic moduli are coupled together. FIG. 5 is a plan view showing the distribution of hardness of the rear outsole 230 when the conical coil spring is used as the elastic member 220. As shown in FIG. 5, the cushioning ability defined by the conical coil spring is sectioned into four approximate sections. Of course, it cannot be precisely sectioned at angular intervals of 90°, as shown in the drawing. The sections illustrate empirically determined relative cushioning abilities. In detail, the S section indicates the section having the softest cushioning ability, and the portion of the rear outsole 230 that has the lowest hardness is located in the section S. The MS (middle soft) section indicates the section having the second softest cushioning ability, and the portion of the rear outsole 230 that has the second lowest hardness is located in the section MS. The MH (middle hard) section indicates the section having the third softest cushioning ability, and the portion of the rear outsole 230 that has the third lowest hardness is located in the section MH. The H section indicates the section having the hardest cushioning ability, and the portion of the rear outsole 230 that has the highest hardness is located in the section H.

In the present invention, the orientation of the subsidiary sole 200 coupled to the main sole 100 can be changed. Therefore, in the case of a user having an abnormal gait, or one who causes partial side wear in the rear outsole 230, the present invention can correct the gait through a method of appropriately changing the orientation of the subsidiary sole 200, and can mitigate the partial side wear phenomenon of the rear outsole 230.

The rear outsole 230, which is coupled to the lower end of the conical coil spring, is preferably made of the same rubber as the material of the front outsole 115. A coupling groove 235 is formed in the upper surface of the rear outsole 230 for coupling to the lower end of the conical coil spring. Preferably, the conical coil spring is fixed to the coupling groove 235 using a bonding agent. The conical coil spring may be made of metal, such as carbon steel. In the embodiment, as an alternative to metal, the conical coil spring may be made of a compound substance containing carbon fiber and glass fiber. Furthermore, the cross-section of a wire constituting the conical coil spring may have various shapes, for example, a rectangular shape, an octagonal shape, a circular shape, a tube shape, etc. Such a tube shape is a hollow shape.

More preferably, as shown in FIG. 3, a thin reinforcing member 237, which has a mesh net shape, is provided in the rear outsole 230. The reinforcing member 237 serves to enhance the strength of the rear outsole 230 and may be manufactured by weaving synthetic resin into a mesh net shape. In the case where the reinforcing member 237 is made of synthetic resin, it is preferable that the reinforcing member 237 be treated to be fireproof. Nylon is a representative example of synthetic resin for the reinforcing member 237. Although the reinforcing member 237 has been illustrated as being made of synthetic resin in the embodiment, the reinforcing member 237 may be made of metal.

Meanwhile, the connection member 210 is coupled to the upper end of the conical coil spring, which is used as the elastic member 220. An internal threaded part 210*a*, into which the bolt b is fastened, is formed in the center of the connection member 210. Several stop protrusions 210*b* are provided around the internal threaded part 210*a* in a circular arrangement.

The structure of the connection member 210 will be explained in detail herein below. A main nut 211 for forming the internal treaded hole 210*a* is provided in the central portion of the connection member 210, and a wire nut 212 is installed in the main nut 211. To form the connection member 210, the main nut 211 coupled to the wire nut 212 is placed in a mold for forming the connection member 210. Synthetic resin is injected into the mold. Then, the connection member 210 having the stop protrusions 210*b* is completed. Preferably, the main nut 211 and the conical coil spring are placed at predetermined positions in the mold, and an injection molding process using synthetic resin is conducted, thus forming the connection member 210. Here, the connection member 210 can have a structure such that it can be integrated with the conical coil spring. The wire nut 212, which is provided in the main nut 211, is directly coupled to the bolt b for coupling the subsidiary sole 200 to the main sole 100 and thus serves to prevent the bolt b from being undesirably loosened by vibration. The wire nut 212 has a shape similar to a coil spring, and a cross-section thereof has a shape such that it can engage with the external thread of the bolt b.

Those skilled in the art will appreciate that the number of stop protrusions provided in the connection member and the shape of each protrusion may be variously changed.

Second Embodiment

Figure 6:
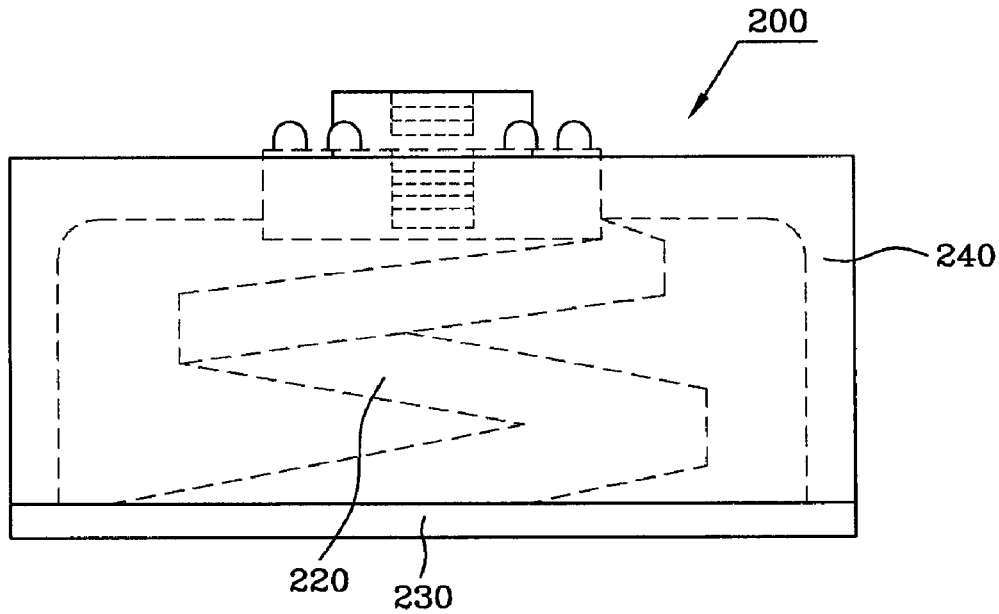
FIG. 6 is a view showing a subsidiary sole of a shoe sole, according to a second embodiment of the present invention.

A shoe sole according to a second embodiment of the present invention has the construction shown in FIG. 6. FIG. 6 is a view showing a subsidiary sole 200 to illustrate critical features of the shoe sole of the second embodiment.

The shoe sole according to the second embodiment of the present invention fundamentally includes a main sole 100, the subsidiary sole 200 and a coupling support 300, in the same manner as that of the first embodiment. However, unlike the first embodiment, the shoe sole according to the second embodiment further includes a protective wall 240, which is provided in the subsidiary sole 200 and surrounds an elastic member 220. It is preferable that the protective wall 240 be formed using polyurethane sponge foam or the like, and that it have approximately 20 to 50 HS (shore hardness). The protective wall 240 extends from an outer edge of an upper surface of a rear outsole 230 upwards to surround the elastic member 220 without impeding the movement of the elastic member 220. Thus, the elastic member 220 is not exposed outside, and is thus not visible from the outside. Furthermore, because the protective wall 240 has predetermined elasticity, it also serves to absorb shocks.

Third Embodiment

Figure 7:
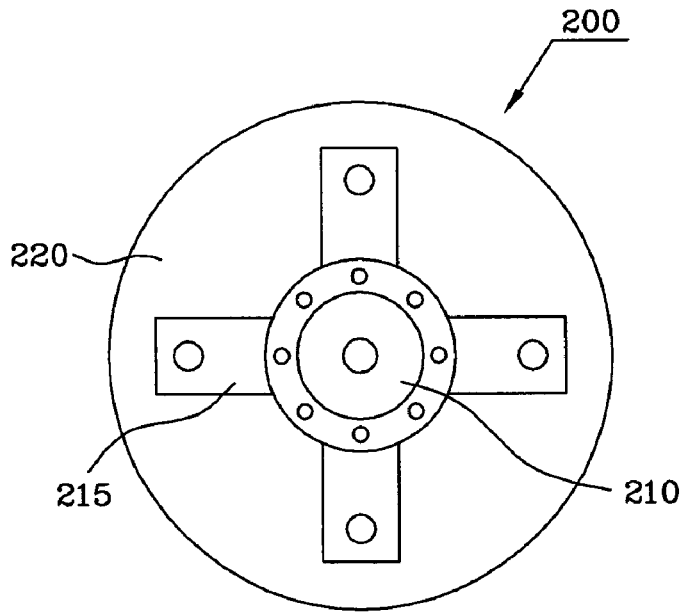
FIG. 7 is a plan view of a subsidiary sole of a shoe sole, according to a third embodiment of the present invention.
Figure 8:
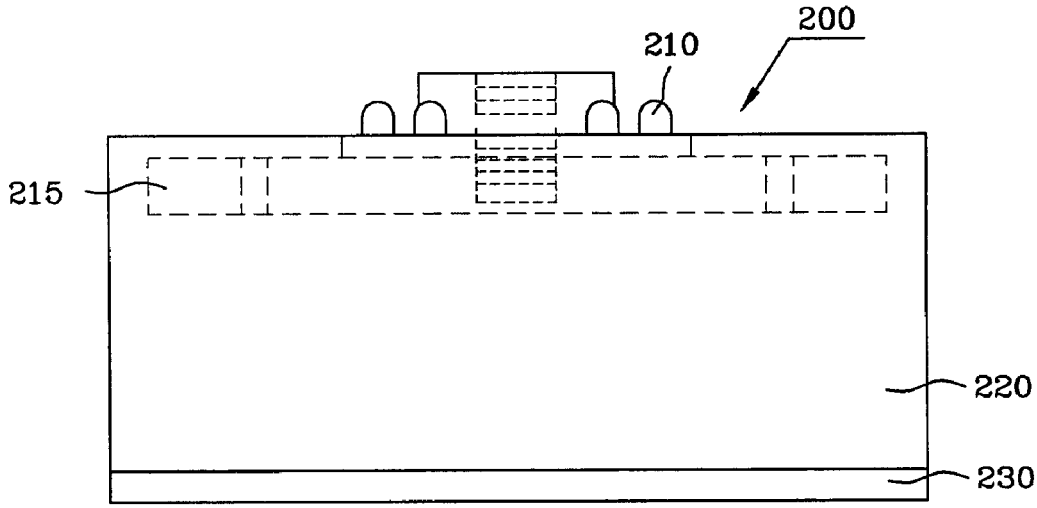
FIG. 8 is a side view of the subsidiary sole according to the third embodiment of the present invention.

FIG. 7 is a plan view of a subsidiary sole 200 to illustrate critical features of a shoe sole, according to a third embodiment of the present invention. FIG. 8 is a side view of the subsidiary sole 200.

The shoe sole according to a third embodiment of the present invention also includes a main sole 100, the subsidiary sole 200 and the coupling support 300, and is characterized by the subsidiary sole 200. The subsidiary sole 200 of the third embodiment includes a connection member 210, an elastic member 220 and a rear outsole 230, which are arranged in order from the upper end to the lower end. Particularly, unlike other embodiments, four arms 215 protrude outwards from the outer edge of the lower end of the connection member 210 at positions spaced apart from each other by angular intervals of 90°. Furthermore, the elastic member 220 may be made of polyurethane sponge foam or the like. In this embodiment, the elastic member 220 is made of polyurethane sponge foam and is formed through injection molding, such that it is integrated with the connection member 210. The polyurethane sponge foam used as the elastic member 220 is sectioned into four sections, and the four sections have different hardnesses. For this, when the elastic member 220 is formed by injection molding, the ratio of constituents of polyurethane sponge foam is appropriately adjusted depending on the section, so that the four sections of the elastic member 220 have different hardnesses. The rear outsole 230 is attached to the lower end of the elastic member 220, in the same manner as that of other embodiments.

Figure 9:
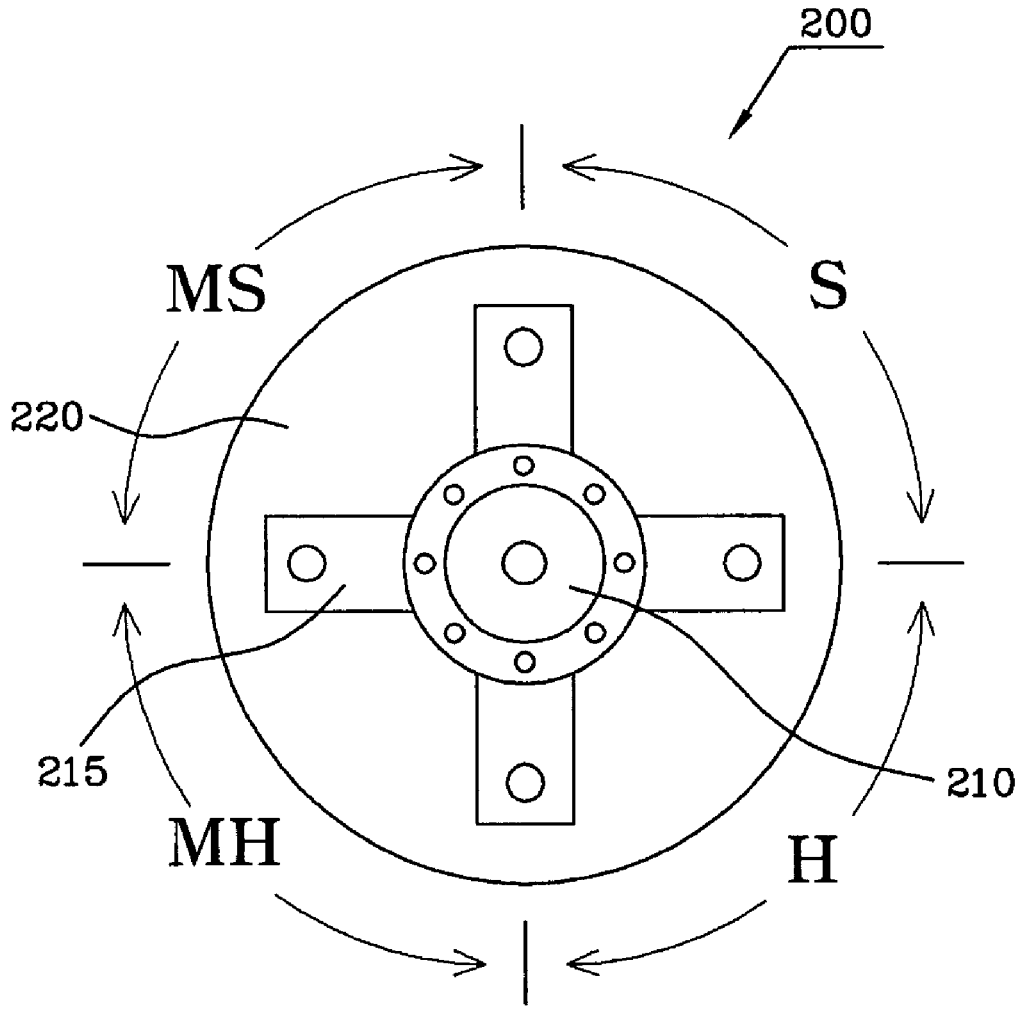
FIG. 9 is a plan view showing the distribution of hardness of the subsidiary sole according to the third embodiment of the present invention.

As shown in FIG. 9, the elastic member 220, which is made of polyurethane sponge foam and constitutes the subsidiary sole 200, is sectioned into the S section, the MS section, the MH section and the H section. Each section has different hardness. The S section has the lowest hardness, and the hardness of the elastic member 220 is gradually increased from the S section to the H section in a counterclockwise direction.

Hereinafter, the operation of the shoe sole of the present invention used in a shoe for correcting an abnormal gait will be described.

The present invention is characterized in that the subsidiary sole 200 can be removably coupled to the main sole 100, and the orientation of the subsidiary sole 200 coupled to the main sole 100 can be changed without restriction. To couple the subsidiary sole 200 to the main sole 100, the subsidiary sole 200 is brought into contact with the main sole 100 such that the stop protrusions 210*b* provided on the connection member 210 are inserted into the desired stop holes 320 formed in the coupling support 300. Subsequently, the bolt b is inserted into the through hole 310, which is formed in the center of the coupling support 300 and extends to the upper surface of the main sole 100, and is fastened into the internal thread part (the wire nut) 210*a* of the connection member 210, which is provided on the upper end of the subsidiary sole 200. Thereby, the subsidiary sole 200 is reliably coupled to the main sole 100.

Furthermore, the orientation of the subsidiary sole 200 can be adjusted, and it can be replaced with a new one using the above-mentioned coupling method.

Figure 10:
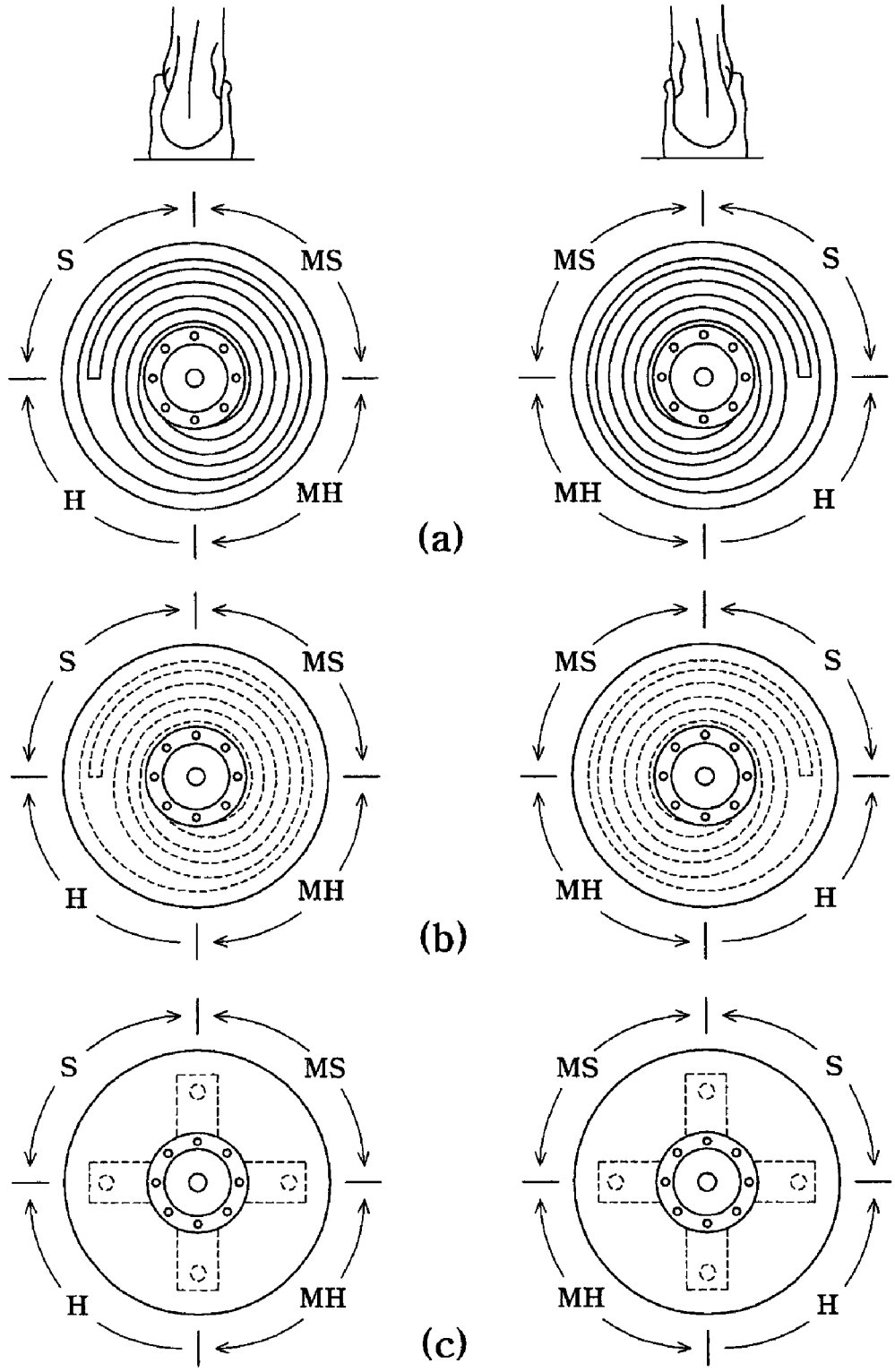
FIG. 10 is views illustrating the orientation of the subsidiary sole for a user having a neutral gait according to the present invention.

FIG. 10 illustrates the preferable orientation of the subsidiary sole for a user having a neutral gait. In the drawing, the left and right feet of the user are shown. FIG. 10*a* is a plan view showing the subsidiary sole according to the first embodiment, FIG. 10*b* is a plan view showing the subsidiary sole according to the second embodiment, and FIG. 10*c* is a plan view showing the subsidiary sole according to the third embodiment.

In the case of the user having a neutral gait, because force is not concentrated on one side, for example, inwards or outwards, it is preferable that the subsidiary sole be oriented such that the S section and the H section are longitudinally aligned.

Figure 11:
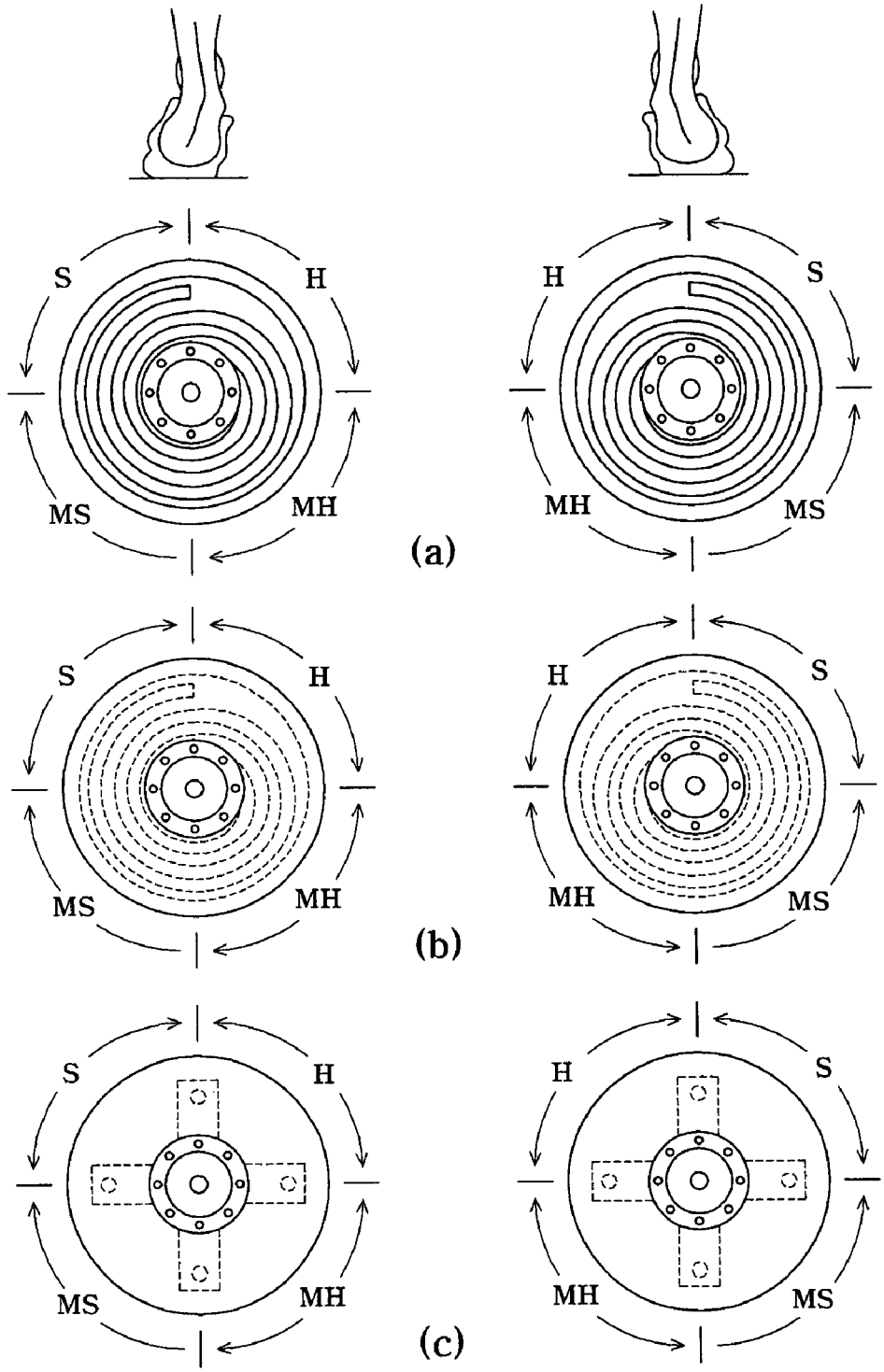
FIG. 11 is views illustrating the orientation of the subsidiary sole for a user having a pronation gait according to the present invention.

FIG. 11 illustrates the orientation of the subsidiary sole for correcting the gait of a user having a pronation gait. In the case of a user having a pronation gait, when his/her foot comes into contact with the ground, because the weight is concentrated on the inside of the foot, it is necessary to reinforce the inside part of the subsidiary sole. In the same manner, FIG. 11*a* is a plan view showing the subsidiary sole according to the first embodiment, FIG. 11*b* is a plan view showing the subsidiary sole according to the second embodiment, and FIG. 11*c* is a plan view showing the subsidiary sole according to the third embodiment. To correct the pronation gait, when the subsidiary sole 200 is coupled to the main sole 100, the subsidiary sole 200 must be oriented such that the H section and the S section of the subsidiary sole 200 are aligned in a lateral direction and the H section is located at an inner position.

Figure 12:
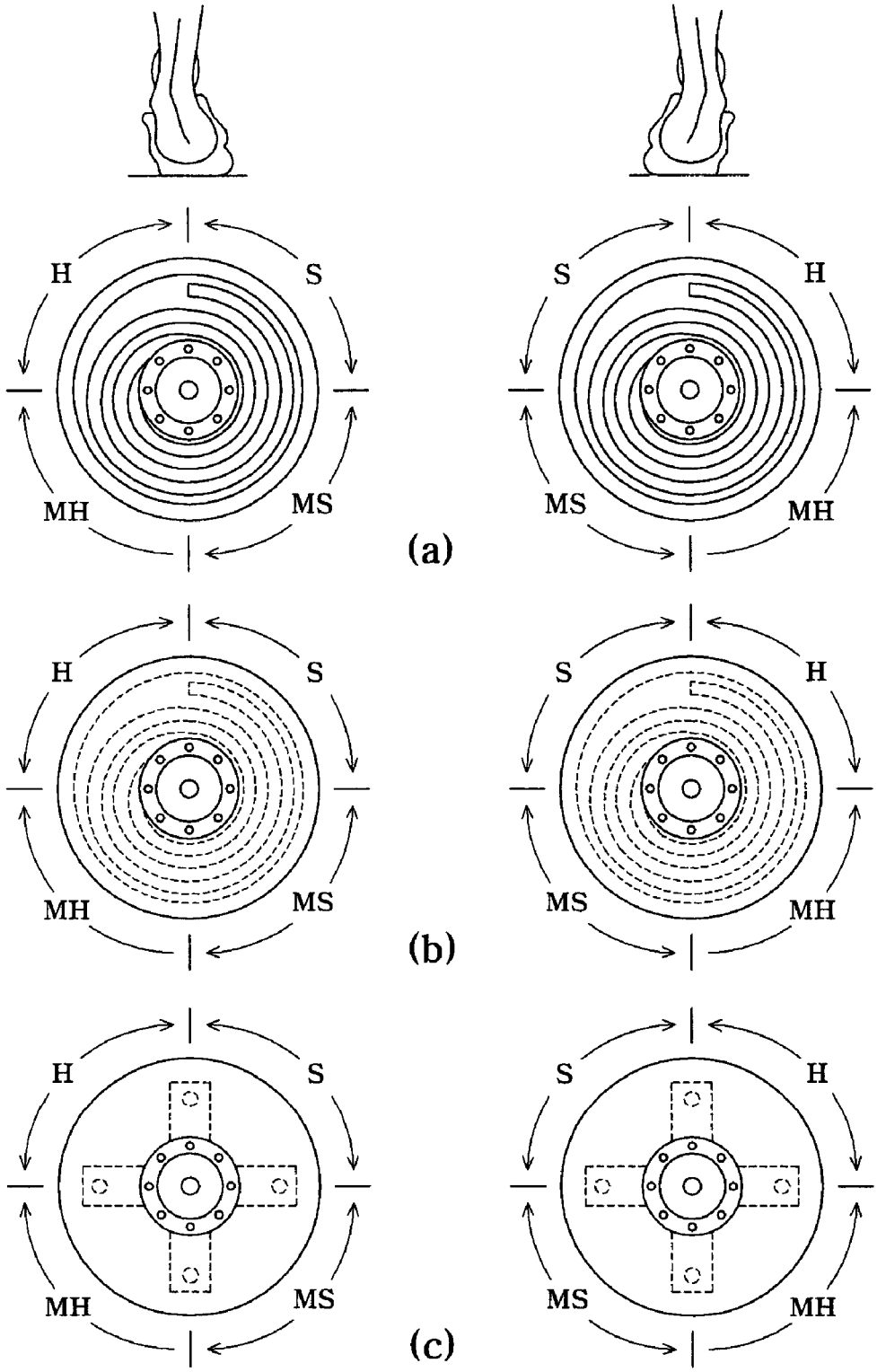
FIG. 12 is views illustrating the orientation of the subsidiary sole for a user having a supination gait according to the present invention.

FIG. 12 illustrates the orientation of the subsidiary sole for correcting the gait of a user having a supination gait. In the case of the user having the supination gait, when his/her foot comes into contact with the ground, because the weight is concentrated on the outside of the foot, the subsidiary sole must be oriented such that the H section and the S section of the subsidiary sole are located in a lateral direction and the H section is located at an outer position.

As such, the present invention helps a user having an abnormal gait to correct his/her gait. Furthermore, in the shoe sole of the present invention, because the subsidiary sole is removably coupled to the main sole without restriction, in the case of the user having the neutral gait, even though partial side wear occurs in the rear outsole with use for a long period, the shoe can continue to be used by changing the orientation of the subsidiary sole or by replacing it with a new one.

As described above, when a user having an abnormal gait wears shoes having the shoe soles of the present invention, there are effects of correcting the abnormal gait of the user and of treating various physical defects induced by the abnormal gait.

Furthermore, in the present invention, because the orientation of a subsidiary sole can be easily changed, and because the replacement thereof is easy, a problem of partial side wear of a rear outsole can be solved, and there is an advantage in that the user may separately purchase only a subsidiary sole including an elastic member having appropriate hardness.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A shoe sole for correcting a gait, comprising:

a main sole, comprising: a front foot part, having a front midsole made of soft material, and a front outsole provided under a lower surface of the front midsole; and a rear foot part, having a rear midsole made of hard material and coupled to an upper surface of the front midsole;

a subsidiary sole, comprising: an elastic member; a rear outsole coupled to a lower end of the elastic member and in contact with ground; and a connection member provided on an upper end of the elastic member, the connection member having an internal threaded part to couple the connection member to a lower surface of the rear midsole, and a plurality of stop protrusions provided around the internal threaded part; and a coupling support provided under the lower surface of the rear midsole, with a plurality of stop holes formed in the coupling support and corresponding to the respective stop protrusions, and a through hole formed in the coupling support at a center of the stop holes and extending to an upper surface of the rear midsole so that a bolt is fastened into the internal threaded part through the through hole, wherein an orientation of the subsidiary sole with respect to the main sole is changeable, or the subsidiary sole is replaceable with another subsidiary sole depending on characteristics of the gait of a user.

2. The shoe sole as set forth in claim 1, wherein the elastic member comprises a conical coil spring.

3. The shoe sole as set forth in claim 1, wherein the elastic member is formed by injection molding using different materials such that the elastic member is sectioned into four sections having different characteristics.

4. The shoe sole as set forth in claim 2, wherein the connection member is integrally coupled to an upper end of the conical coil spring through an injection molding process.

5. The shoe sole as set forth in claim 3, wherein the connection member comprises four arms provided on an outer edge of a lower end of the connection member at positions spaced apart from each other by angular intervals of 90°, such that, when the elastic member is formed by injection molding using the different materials, a coupling force between the connection member and the elastic member is increased by the four arms.

6. The shoe sole as set forth in claim 1, wherein the subsidiary sole comprises a protective wall provided on the rear outsole to surround the elastic member.

7. The shoe sole as set forth in claim 1, wherein the connection member comprises:

a main nut forming the internal threaded part; and a wire nut provided in the main nut and coupled to the bolt to prevent the bolt from being loosened.

8. The shoe sole as set forth in claim 2, wherein the conical coil spring is made of a wire, which has a cross-section having one shape selected from among a rectangular shape, an octagonal shape, a circular shape and a tube shape.

9. The shoe sole as set forth in claim 2, wherein the wire constituting the conical coil spring is made of metal or a compound substance containing carbon fiber and glass fiber.

10. The shoe sole as set forth in claim 1, wherein the rear midsole is made of material, in which 10 to 15 weight parts of glass fiber are mixed with 100 weight parts of nylon 66 resin, and is injection molded at a high temperature.

11. The shoe sole as set forth in claim 1, further comprising:

a reinforcing member provided in the rear outsole and manufactured by weaving into a mesh shape.

12. The shoe sole as set forth in claim 2, wherein the subsidiary sole comprises a protective wall provided on the rear outsole to surround the elastic member.

13. The shoe sole as set forth in claim 4, wherein the subsidiary sole comprises a protective wall provided on the rear outsole to surround the elastic member.

14. The shoe sole as set forth in claim 8, wherein the wire constituting the conical coil spring is made of metal or a compound substance containing carbon fiber and glass fiber.

15. The shoe sole as set forth in claim 2, further comprising:

a reinforcing member provided in the rear outsole and manufactured by weaving into a mesh shape.

16. The shoe sole as set forth in claim 4, further comprising:

a reinforcing member provided in the rear outsole and manufactured by weaving into a mesh shape.

17. The shoe sole as set forth in claim 7, further comprising:

a reinforcing member provided in the rear outsole and manufactured by weaving into a mesh shape.

18. The shoe sole as set forth in claim 8, further comprising:

a reinforcing member provided in the rear outsole and manufactured by weaving into a mesh shape.

* * * * *